US010149034B2

(12) United States Patent
Tsubone

(10) Patent No.: US 10,149,034 B2
(45) Date of Patent: Dec. 4, 2018

(54) EARPHONE

(71) Applicant: AUDIO-TECHNICA CORPORATION, Machida-shi, Tokyo (JP)

(72) Inventor: Kodai Tsubone, Machida (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days.

(21) Appl. No.: 15/605,462

(22) Filed: May 25, 2017

(65) Prior Publication Data

US 2018/0035193 A1 Feb. 1, 2018

(30) Foreign Application Priority Data

Jul. 29, 2016 (JP) ..... 2016-149206

(51) Int. Cl.
*H04R 25/00* (2006.01)
*H04R 1/10* (2006.01)
(Continued)

(52) U.S. Cl.
CPC ..... *H04R 1/1016* (2013.01); *H04R 1/10* (2013.01); *H04R 1/1075* (2013.01); *H04R 1/24* (2013.01);
(Continued)

(58) Field of Classification Search
CPC ..... H04R 1/1016; H04R 1/1075; H04R 1/24; H04R 1/2857
(Continued)

(56) References Cited

U.S. PATENT DOCUMENTS 7,634,099 B2 12/2009 Harvey et al.
8,194,911 B2 6/2012 Dyer et al.
(Continued)

FOREIGN PATENT DOCUMENTS

EP 2101512 A1 9/2009
EP 2566184 A1 3/2013
(Continued)

OTHER PUBLICATIONS

Europe Patent Office, "Search Report for European Patent Application No. 17178927.4," dated Nov. 7, 2017.
(Continued)

*Primary Examiner* — Davetta W. Goins
*Assistant Examiner* — Phylesha Dabney
(74) *Attorney, Agent, or Firm* — Manabu Kanesaka

(57) ABSTRACT

An earphone includes a first driver units reproducing sound waves in a high-frequency range, a second driver units reproducing sound waves other than the high-frequency range of the first driver units, and a unit case for housing the respective driver units and a sound delivery tube for leading sound waves from the driver units to a user's ear canal, the sound delivery tube being formed to communicate with the unit case. A sound emission axis of the first driver units and a sound emission axis of the second driver units are disposed in parallel to each other, and the sound emission axis of the first driver unit passes through in an opening of the sound delivery tube. This construction, including multiple driver units for producing different frequency ranges, allows to provide an earphone in which attenuation of high-frequency components in particular is reduced.

4 Claims, 4 Drawing Sheets

(51) Int. Cl.
*H04R 1/24* (2006.01)
*H04R 1/28* (2006.01)

(52) U.S. Cl.
CPC ..... *H04R 1/2857* (2013.01); *H04R 25/604* (2013.01)

(58) Field of Classification Search
USPC ..... 381/380, 382
See application file for complete search history.

(56) References Cited

U.S. PATENT DOCUMENTS

| | | | |
|---|---|---|---|
| 8,311,259 | B2 | 11/2012 | Pinter et al. |
| 8,948,435 | B2 | 2/2015 | Oosato et al. |
| 9,571,933 | B2 | 2/2017 | Pan |
| 2014/0205131 | A1 | 7/2014 | Azmi et al. |
| 2015/0113795 | A1 | 4/2015 | Depallens et al. |

FOREIGN PATENT DOCUMENTS

| | | | |
|---|---|---|---|
| EP | 2765788 | A2 | 8/2014 |
| WO | 2008/118248 | | 10/2008 |

OTHER PUBLICATIONS

Sony XBA-300 http://www.sony.jp/headphone/products/XBA-300/feature_1.html.
Shure SE535 "SE 535 Sound Isolating Earphones" https://www.shure.co.jp/ja/products/earphones/se535.
Ultimate Ears Triple FI 10 http:phileweb.com/review/closeup/triplefi10pro/.

EARPHONE

RELATED APPLICATIONS

The present application is based on, and claims priority from, Japanese Application No. JP2016-149206 filed Jul. 29, 2016, the disclosure of which is hereby incorporated by reference herein in its entirety.

BACKGROUND OF THE INVENTION

Field of the Invention

The present invention relates to in-ear headphones, such as canal headphones (ear plug type), which enable a reproduced sound from driver units to propagate faithfully.

Description of the Related Art

A canal earphone includes a driver unit that reproduces sound waves on receiving an audio signal, a unit case that accommodates the driver unit, a sound delivery tube that communicates with the unit case and leads a reproduced sound (sound waves) to users' ear canal, and an eartip that is provided to cover the tip end portion of the sound delivery tube.

Such a canal earphone has an advantage of high isolation not affected by ambient noises, because the eartip is worn in close contact with the users' ear canal.

In recent years canal ear phones have been also provided which use balanced armature driver units (hereafter BA driver units) in place of a dynamic driver unit.

The BA driver unit has a unit case housing components such as a magnet, a coil, an armature and a diaphragm. The armature (a piece of iron plate) is vibrated by a drive current corresponding to an audio signal and vibration of the armature is transmitted to the diaphragm through a drive rod to reproduce sound waves.

The diaphragm of the BA driver unit can vibrate faithfully to the audio signal without being subjected to air resistance because the diaphragm is made of a rigid metal plate. Consequently, the driver has characteristics of a sufficient transient response and of a high sound pressure level of sound output corresponding to an input signal, i.e., high sensitivity.

Since the BA driver unit, however, due to its operation principle, has a drawback of a narrow frequency range of sound reproduction at low distortion, a multiple BA driver unit is employed that is a combination of special driver units having separated frequency bands for a high frequency range and a low frequency range.

The canal earphones using multiple BA driver units are disclosed in

Patent Literature such as U.S. Pat. No. 7,634,099 (Patent Literature 1) and in

Non-Patent Literature, for example, as follows:

Non-Patent Literature 1:

"300 Balanced Armature In-ear Headphones", URL: http://www.sony.com.sg/electronics/in-ear-headphones/xba-300ap, Non-Patent Literature 2:

"SE 535 Sound Isolating Earphones", URL: https://www-.shure.co.jp/ja/products/earphones/se535, Non-Patent Literature 3:

"Ultimate Ear TripleFi 10 Noise-Isolating Earphones", URL: http://support.logitech.com/en_sg/product/triplefi-10.

FIG. 4 shows examples of the canal earphone provided with multiple BA driver units disclosed in Patent Literature 1 and Non-Paten Literature references 1 through 3, showing a state where a part of the unit case is cut away.

An earphone 1 shown in FIG. 4 is provided with, as basic components, three driver units 2*a*, 2*b* and 2*c*, a unit case that houses the drivers 2*a*, 2*b* and 2*c*, a sound delivery tube 4 that communicates with the unit case 3, and an eartip 5 attached on an outer circumferential surface of the sound delivery tube 4. Inside of the tip part of the sound delivery tube 4, a damper 6 made of acoustic resistance material is attached as needed.

In an example shown in FIG. 4, the driver unit 2*a* is a BA driver unit for reproducing sound frequencies in a treble range mainly, and a pair of BA units 2*b* and 2*c* is for sound frequencies in a mid- and low-range. A multiple BA unit is composed of three driver units in the example. In FIG. 4, the driver unit 2*c* is disposed behind the driver unit 2*b* and is hidden partly.

A base member 3*a*, a cover 3*b*, and a connecting portion 3*c* at the center which connects the base member and the cover constitute a unit case that houses respective drive units 2*a*, 2*b*, and 2*c*, and each of which is made of resin material. The sound delivery tube 4 is integrally formed with the base member 3*a*.

Each of BA driver units 2*a*, 2*b* and 2*c* housed in the unit case 3 has a cuboid unit chassis 21 as an outer shell, and sound from each driver unit is emitted from a sound outlet nozzle 22 which is formed to protrude cylindrically along the longitudinal direction of the cuboid. In the example shown in FIG. 4, BA driver units 2*b* and 2*c* for reproducing sounds in the mid-frequency and low-frequency range are configured to emit sound from a single sound outlet nozzle 22 by connecting each unit chassis 21.

Each of the BA driver units 2*a*, 2*b* and 2*c* is positioned in the unit case 3 with protecting member 7 made of soft material such as rubber such that the sound emission axes A1 and A2 of each sound outlet nozzle 22 are parallel to each other.

In the prior art references cited above, a configuration is adopted such that the sound emission axes A1 and A2 that pass through the sound outlet nozzle of the driver units 2*a*, 2*b* and 2*c* and the center axis at the opening portion of the sound delivery tube 4 communicating with the unit case 3 forms a specific angle.

It is understood that this configuration is adopted from the view point of an increase of the unit case 3 in size due to accommodation of a plurality of BA units in the case 3, and consideration of a feeling of wearing to user's ear canal or concha of the ear affected by formation of sound delivery tube 4 that communicates with the unit case 3.

SUMMARY OF THE INVENTION

Incidentally, in the earphone 1 shown in FIG. 4, a reproduced sound from the sound outlet nozzle 22 of the each of the BA driver units is reflected in an inner wall of the unit case 3 and arrives at a tympanic membrane of the user through the sound delivery tube 4 communicating with the unit case 3. In the example shown in FIG. 4, as shown by the sound emission axes A1 and A2, the reproduced sound from the sound outlet nozzle 22 of the BA driver unit nearly vertically hits against the wall in the unit case 3 and is reflected and arrives at user's tympanic membrane through the sound delivery tube 4.

According to such a propagation system, a high-frequency range sound, having a particularly strong directivity, emitted from the BA driver unit is attenuated strongly. Since the size of the diaphragm of the BA unit driver for the high-frequency range sound is small and the amplitude of vibration is also small; therefore, reflection loss in amplitude of high-frequency range sound becomes further larger. In conventional canal-type earphones, the overall frequency response may be deteriorated due to overlapping of the above described factors.

Accordingly, one of the main objects of the present invention is to provide an earphone having a preferred frequency response by particularly suppressing attenuation of high-frequency components, in an ear phone using a plurality of specific BA driver units. Another object of the invention is to provide an earphone wearable to users' ear concha without an uncomfortable feeling, by considering a positional relationship between the BA driver units disposed in the unit case to reduce a size of the unit case 3.

An earphone according to the present invention for solving the above problem includes: a first driver unit that reproduces sound waves of a high frequency range, a second driver unit that reproduces sound of a frequency range other than the frequency range of the first driver unit, a unit case that houses the first and the second driver units, a sound delivery tube, which communicates with the unit case, that leads the reproduced sound to a user's ear concha, wherein the drivers are disposed such that sound emission axes of the first driver unit and the second driver unit are parallel to each other, and the sound emission axis of the first driver unit is disposed to pass through an opening area of the sound delivery tube.

In this case balanced armature driver units are used for each of the drive units.

The first driver unit that reproduces a sound wave of a high frequency range is preferably accommodated in the unit case such that the sound emission axis of the first driver unit is disposed to coincide with a central axis of the opening area of the sound delivery tube.

The configuration is preferably adopted in which the sound outlet nozzle of the second driver unit is disposed at a retracted position with respect to the position of the sound outlet nozzle of the first drive unit along the sound emission axis parallel to the sound outlet nozzle of the first driver unit.

The sound delivery tube preferably configures a canal type earphone by having an eartip on an outer circumferential surface thereof.

An earphone according to the present invention has a feature that the sound emission axis of the drive unit that reproduces sound waves particularly including a high-frequency range is disposed so as to pass through the opening of a sound delivery tube communicating with the unit case. This structure allows the sound waves of the high-frequency range in particular to be guided to user's ear concha as a direct sound without being affected by reflection in the unit case; an earphone achieving a comprehensively preferable frequency response can be provided.

In addition to the above configuration, by employing another configuration in which the sound outlet nozzle of the driver unit reproducing sound waves of other than high frequency range is disposed at a retracted position with respect to the sound outlet nozzle of the driver unit reproducing sound waves including a high-frequency range along the parallel sound emission axes, driver units are disposed in a unit case without requiring to enlarge the size of the unit case in which the driver units are accommodated. This makes it possible to provide an earphone that can be worn on the user's concha without feeling uncomfortable.

DESCRIPTION OF THE PREFERRED EMBODIMENT

Figure 1:
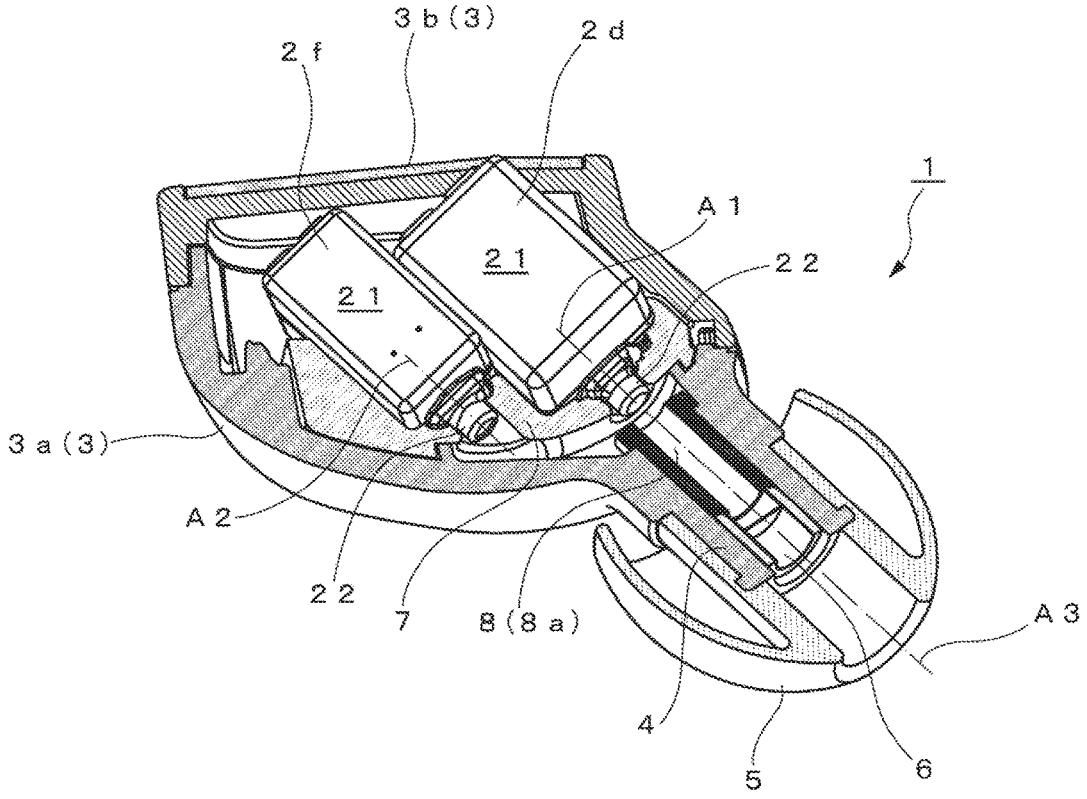
FIG. 1 is a perspective view illustrating an earphone according to the present invention shown in a cutaway unit case and eartip.

An earphone according to the present invention will be described on the basis of an embodiment with reference to drawings FIGS. 1 through 3. In the following embodiments, members, whose functions are the same as those shown in FIG. 4, are denoted by the same reference numerals.

An earphone shown in FIG. 1 is a canal type earphone. This canal type ear phone includes, as basic components, four driver units 2*d* to 2*g*, a unit case 3 that houses the driver units 2*d* to 2*g*, a sound delivery tube 4 that communicates with the unit case 3 as to lead sound waves to a user's ear canal, and an eartip attached to an outer circumferential surface of the sound delivery tube 4.

The unit case 3 is composed of a base member 3*a* which is a front half of the unit case and a cover 3*b* which is a rear half of the unit case. Further, a sound delivery tube is integrally formed in the base member 3*a*, and the unit case is formed by fitting the cover 3*b* to the base member 3*a*.

The unit case 3 is preferably formed of ABS resin, but is not limited thereto.

Further, an internal space having a predetermined volume is formed inside the unit case 3, and the four driver units 2*d* to 2*g* are mounted in the space by being positioned with protecting material 7 that is formed with a soft material such as rubber.

The four driver units 2*d* through 2*g* are composed of BA driver units, respectively and each of cuboid unit chassis 21 constitutes an outer shell, as shown in FIG. 1. Among the driver units, the driver unit 2*d* reproduces high-frequency sounds, and the driver unit 2*e* reproduces mid-frequency sounds. The unit chassis 21 of the driver units 2*d* and 2*e* are attached at side surfaces thereof and include a sound outlet nozzle 22 which intrudes in a cylindrical manner along the longitudinal direction. The nozzle 22 emits high- and mid-frequency sounds.

Two driver units 2*f*, 2*g*, having the same characteristics and reproducing low frequency sounds, are used in order to increase the volume of a low frequency range. Similarly, the unit chassis 21 of the driver units 2*f* and 2*g* are attached at side surfaces thereof and include a sound outlet nozzle 22 which intrudes in a cylindrical manner along the longitudinal direction. The nozzle 22 emits low-frequency sounds.

In this embodiment, driver units denoted by reference numerals 2*d* and 2*e* are referred to as a first driver unit for reproducing sound waves including in a high-frequency range. And driver units denoted by reference numerals 2*f* and 2*g* are referred to as a second driver unit for reproducing sound waves of a frequency range other than those reproduced by the first driver unit.

That is, in this embodiment, four BA driver units form a multiple BA driver unit including the first and second driver units.

As shown in FIG. 1, the driver units are located so that a sound emission axis A1 of the first driver unit 2*d* and 2*e* and a sound emission axis A2 of the second driver units 2*f* and 2*g* are placed in parallel to each other. Further the driver units 2*d* and 2*e* that reproduce sound waves including those in a high-frequency range such that the sound emission axis A1 of the first driver units 2*d* and 2*e* coincides with the central axis A3 of the opening of a sound delivery tube 4 in the unit case.

In this embodiment, a metal sound delivery tube 8 formed cylindrically with metal materials such as brass, titanium or stainless steel is inscribed with the inner surface of the sound delivery tube 4 made of resin, formed integrally with the unit case 3. A damper 6 made of an acoustic resistance material, in addition, is disposed in the sound delivery tube made of resin to make a contact with a front edge of the metal sound delivery tube 8.

The metal sound delivery tube 8 is used intendedly to obtain a sound quality specific to metal materials, and as a result a specific response of crisp sound in a high-frequency range, as exemplified with brass instruments. This structure can provide the earphone with which a comprehensively favorable frequency response can be obtained.

It is configured that the sound emission axis A1 of the first driver unit (2*d* and 2*e*) coincides with the central axis A3 of the opening 8*a* of the metal sound delivery tube 8 that is disposed in the sound delivery tube 4. This configuration allows reproduced sound waves in a high-frequency range from the first driver units (2*d* and 2*e*) to enter the ear canal of the user as a direct sound without being subjected to influence of reflection in the unit case 3. This structure can also provide the earphone which can achieve a comprehensively favorable frequency response.

Figure 2:
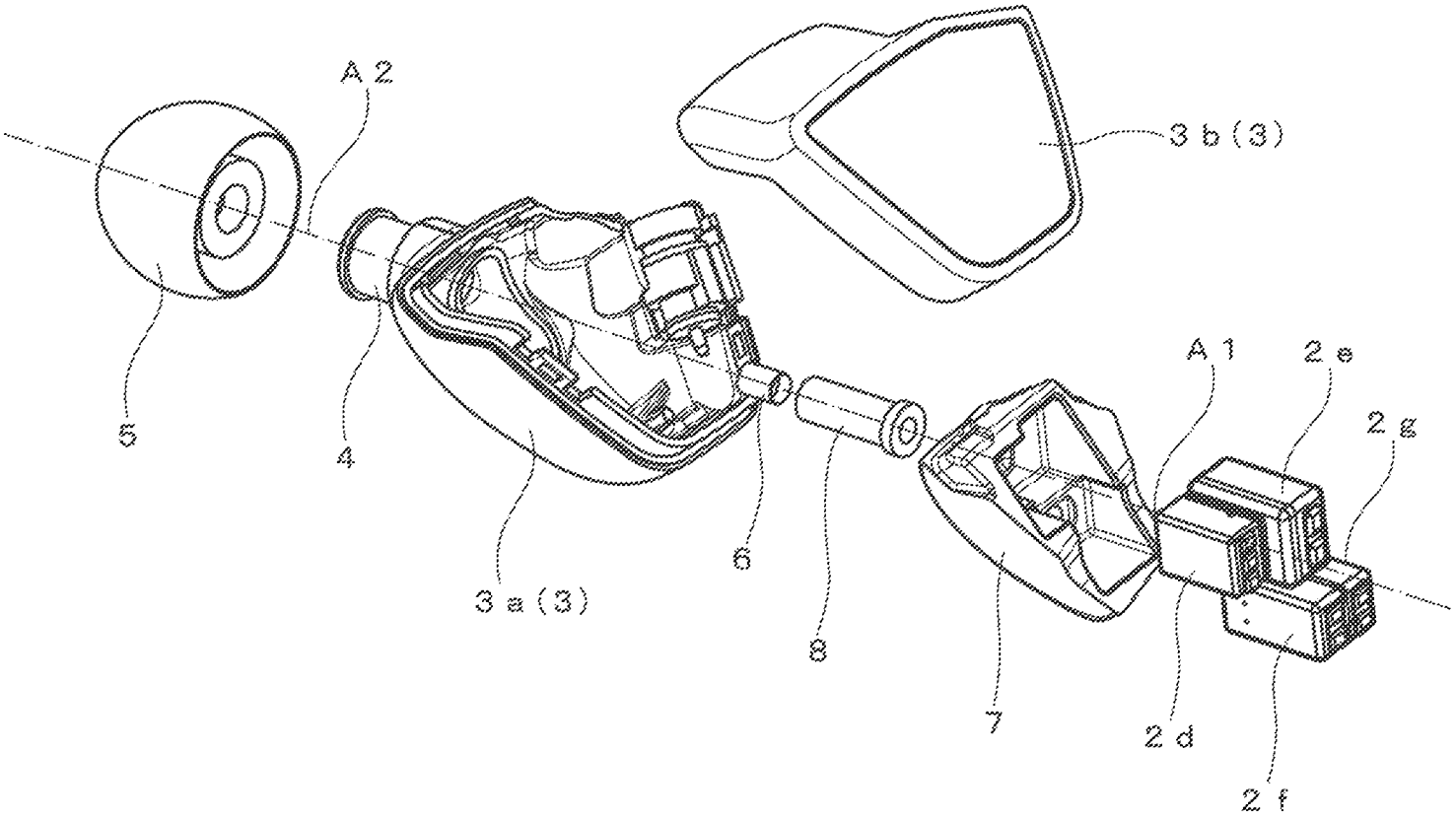
FIG. 2 is a perspective view in which the earphone illustrated in FIG. 1 is exploded into main parts.
Figure 3:
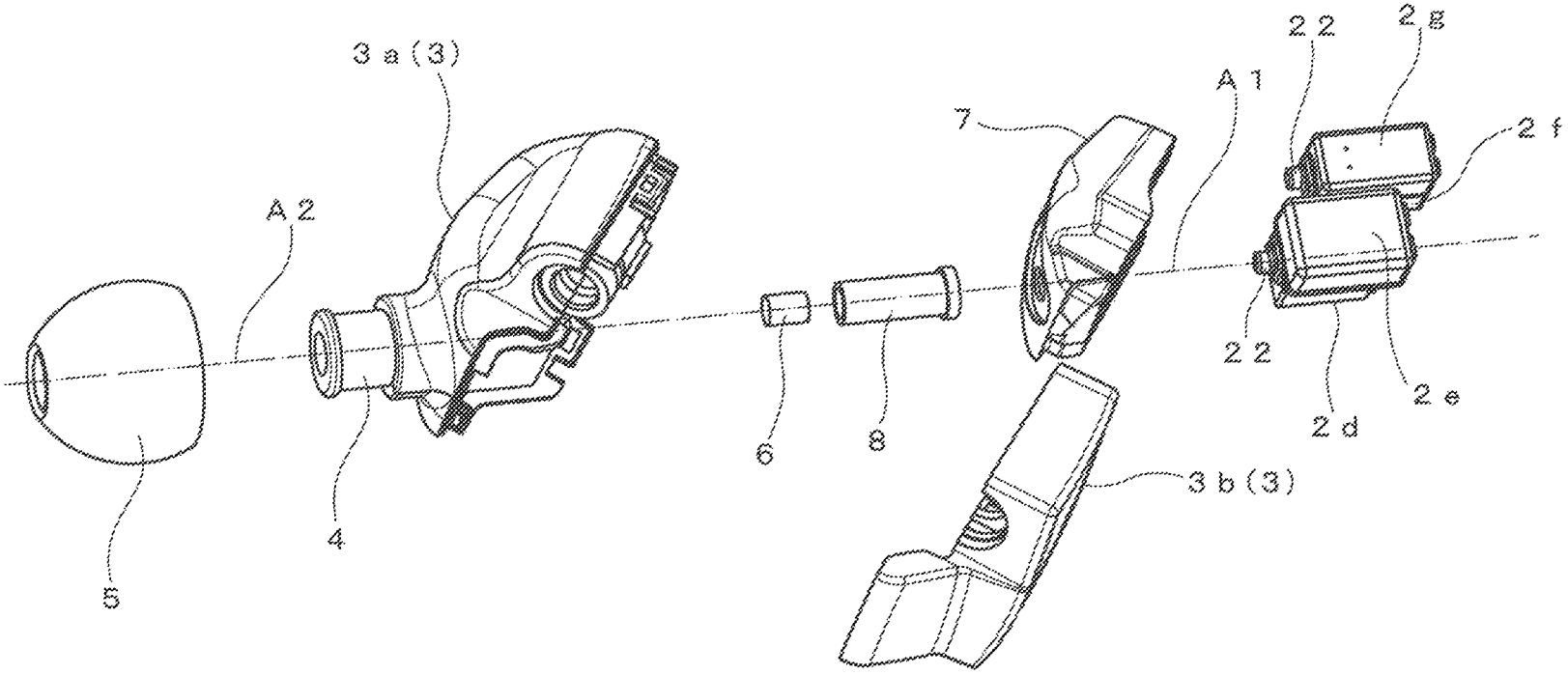
FIG. 3 is an exploded perspective view seen in a different direction.
Figure 4:
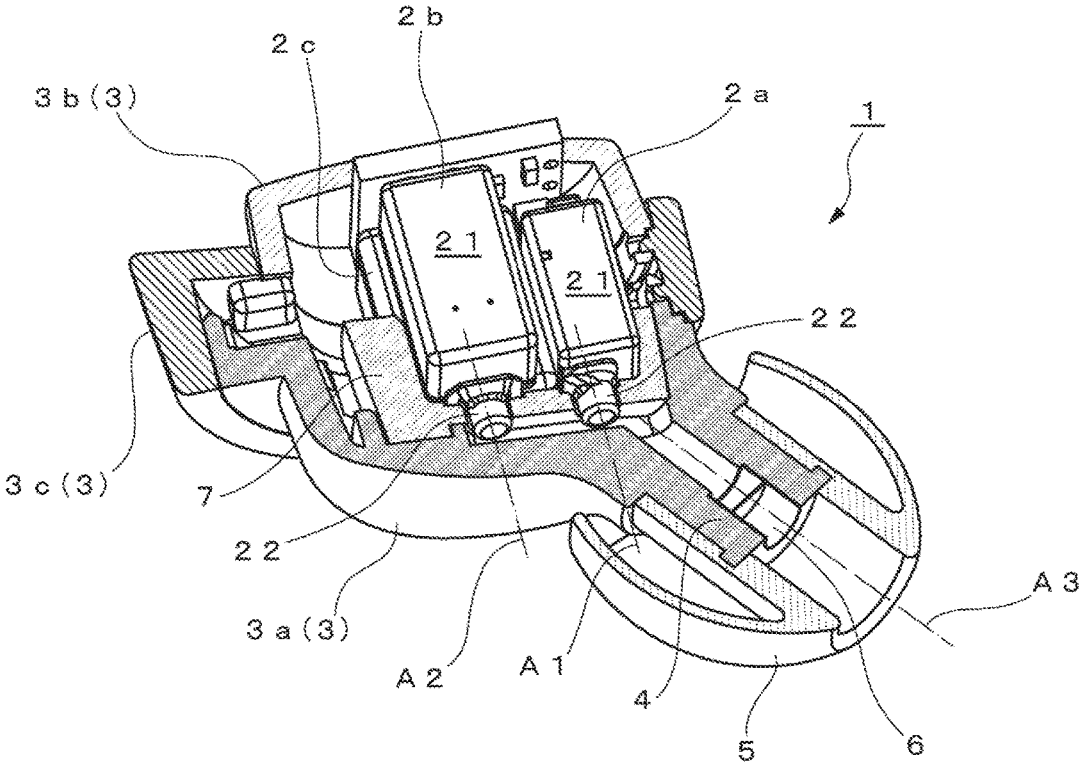
Fig. 4 Related Art
FIG. 4 is a perspective view illustrating an example of a conventional earphone in a cutaway unit case and eartip.

In FIGS. 1 to 3, an example is shown where the sound emission axis A1 of the first driver unit (2*d* and 2*e*) coincides with the central axis of the opening 8*a* of the metal sound delivery tube 8 that is disposed in the sound delivery tube 4. Another configuration may allow to achieve a similar effect if the sound emission axis of the first driver units (2*d* and 2*e*) passes through the opening 8*a* of the metal sound delivery tube 8, forming a predetermined angle with A3, without coincidence of the axes of A1 and A3.

As previously described, the sound emission axis A2 of the second driver unit (2*f* and 2*g*) is disposed in parallel to the sound emission axis A1 of the driver units (2*d* and 2*e*) in this embodiment.

According to this configuration, it is possible to prevent the inner surface of the unit case 3 opposing to the sound outlet nozzle 22 from being disposed perpendicularly to the path from the sound outlet nozzle 22 of the second driver unit 2*f* and 2*g* to the opening 8*a* of the metal sound delivery tube 8.

Further, in the present embodiment, the sound outlet nozzle 22 of the second driver unit (2*f* and 2*g*) is located at a position further backward than the sound outlet nozzle 22 of the first driver unit (2*d* and 2*e*) on the sound emission axis A2 parallel to the sound emission axis A1 as illustrated in FIG. 1.

According to this configuration, the first and second driver units can be housed in the unit case 3 without the need for increasing the outer shell size of the unit case 3. Accordingly, it is possible to provide the earphone which can be worn on the user's ear concha with no uncomfortable feeling.

Meanwhile, although the configuration of having the four driver units has been shown in the embodiment, the present invention may be applied to any type of configuration of a multi BA driver unit such as a configuration having one driver unit for mid- and low-frequency sound and one driver unit for high-frequency sound or a configuration having respective driver units for low-, mid-, and high-frequency sound.

What I claim is:

1. An earphone comprising:

a first balanced armature driver unit reproducing sound waves in a high-frequency range;

a second balanced armature driver unit reproducing sound waves other than the sound waves reproduced from the first driver unit;

a unit case in which the first and second balanced armature driver units are housed;

a sound delivery tube for leading sound waves from the first and second balanced armature driver units to a user's ear canal, the sound delivery tube being formed to communicate with the unit case; and an eartip attached to an outer circumferential surface of the sound delivery tube, wherein a sound emission axis of the first balanced armature driver unit and a sound emission axis of the second balanced armature driver unit are disposed in parallel to each other, and the sound emission axis of the first balanced armature driver unit passes through in an opening of the sound delivery tube, and the first balanced armature driver unit is disposed in the unit case such that the sound emission axis of the first balanced armature driver unit coincides with a central axis of the opening of the sound delivery tube, and is configured to reach linearly directly an outside of the sound delivery tube without contacting an inner part of the sound delivery tube.

2. An earphone according to claim 1, wherein a sound outlet nozzle of the second balanced armature driver unit is located at a retracted position with respect to a position of the sound outlet nozzle of the first balanced armature drive unit on the sound emission axis of the second balanced armature driver unit parallel to the sound outlet nozzle of the first balanced armature driver unit.

3. An earphone according to claim 1, wherein the first balanced armature drive unit and the second balanced armature drive unit are arranged side by side in the unit case, and the second balanced armature drive unit is located apart from the sound delivery tube in a direction of the sound emission axis of the second balanced armature drive unit relative to the first balanced armature drive unit such that the sound waves from the second balanced armature drive unit is reflected by an inner wall of the unit case, reaches the sound delivery tube and is ejected therefrom.

4. An earphone according to claim 1, further comprising a metal sound delivery tube and a damper arranged adjacent to the metal sound delivery tube, each of the metal sound delivery tube and the damper having being inscribed with an inner surface of the sound delivery tube, wherein the opening of the metal sound delivery tube, the damper, and the sound delivery tube are coaxially arranged such that the sound emission axis of the first balanced armature drive unit is located on central axes of the metal sound delivery tube, the damper, and the sound delivery tube.

* * * * *